US006929124B2

(12) United States Patent
Kawasaki

(10) Patent No.: US 6,929,124 B2
(45) Date of Patent: Aug. 16, 2005

(54) GOLF CLUB SAVER

(76) Inventor: Kevin Kawasaki, 1 Oxford Ct. North, Belmont, CA (US) 94002

( * ) Notice: Subject to any disclaimer, the term of this patent is extended or adjusted under 35 U.S.C. 154(b) by 32 days.

(21) Appl. No.: 10/602,224

(22) Filed: Jun. 23, 2003

(65) Prior Publication Data

US 2004/0256259 A1 Dec. 23, 2004

(51) Int. Cl.[7] ..... A63B 55/00
(52) U.S. Cl. ..... 206/315.2; 206/315.6
(58) Field of Search ..... 206/315.2, 315.3, 206/315.6; 211/70.2

(56) References Cited

U.S. PATENT DOCUMENTS

| | | | | | |
|---|---|---|---|---|---|
| 3,931,842 | A | * | 1/1976 | White | 428/36.9 |
| 4,029,136 | A | * | 6/1977 | Jacoby | 221/208 |
| 4,200,131 | A | * | 4/1980 | Chitwood et al. | 206/315.6 |
| 4,332,283 | A | * | 6/1982 | Rader | 206/315.6 |
| 4,664,382 | A | * | 5/1987 | Palmer et al. | 473/288 |
| 4,746,014 | A | | 5/1988 | Very | |
| 4,911,465 | A | * | 3/1990 | Hauer | 280/646 |
| 4,938,349 | A | * | 7/1990 | Burns | 206/315.6 |
| 4,944,396 | A | * | 7/1990 | Larkin | 206/315.6 |
| 5,050,884 | A | | 9/1991 | Flory | |
| 5,275,278 | A | * | 1/1994 | Henry et al. | 206/315.6 |
| 5,575,720 | A | * | 11/1996 | Daniel | 473/282 |
| 5,720,388 | A | * | 2/1998 | King et al. | 206/315.2 |
| 5,834,738 | A | * | 11/1998 | Wilson | 219/400 |
| 5,950,823 | A | | 9/1999 | Flis | |
| 6,102,202 | A | * | 8/2000 | Jones | 206/315.6 |
| 6,216,864 | B1 | * | 4/2001 | Chang | 206/315.2 |
| 6,343,692 | B1 | | 2/2002 | Park | |
| 6,464,076 | B2 | * | 10/2002 | Tan | 206/315.6 |
| 2002/0108873 | A1 | | 8/2002 | St. Jeor | |
| 2002/0132679 | A1 | | 9/2002 | Wilde et al. | |

FOREIGN PATENT DOCUMENTS

| | | |
|---|---|---|
| JP | 11-137747 | 5/1999 |
| WO | WO 02/32515 A1 * | 4/2002 |

OTHER PUBLICATIONS

International Search Report mailed on Nov. 23, 2004 for PCT patent application PCT/US04/20174 filed on Jun. 22, 2004, 4 pages.

* cited by examiner

*Primary Examiner*—Sue A. Weaver
(74) *Attorney, Agent, or Firm*—Morrison & Foerster LLP

(57) ABSTRACT

A storage apparatus for storing a golf club comprising a spring-loaded inner tube positioned within an outer tube for holding golf clubs. In one variation, the inner tube comprises grippers or arm extensions for securing the golf club when the inner tube is pushed downward within the outer tube. A locking mechanism may be provided for maintaining the inner tube in the retracted position. In on variation, the apparatus is configured such that when a user presses the golf club downward the locking mechanism releases the inner tube and pushes the inner tube upward to a predefined position. In this variation, the golf club is maintained in the raised position until the user pushes the club downward and engages the locking mechanism to keep the inner tube in the retracted position.

27 Claims, 4 Drawing Sheets

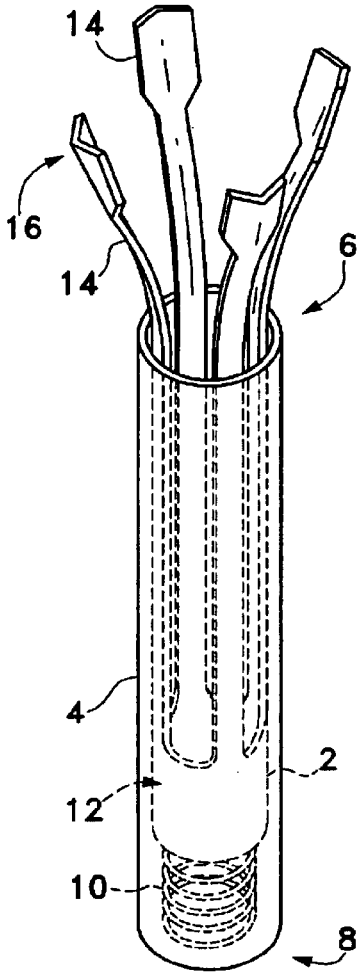
FIG. 1A
FIG. 1B
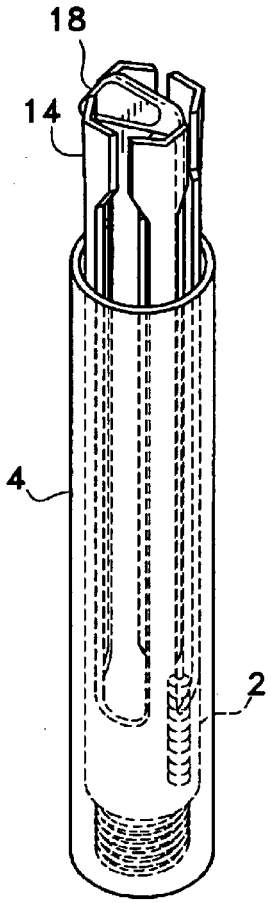
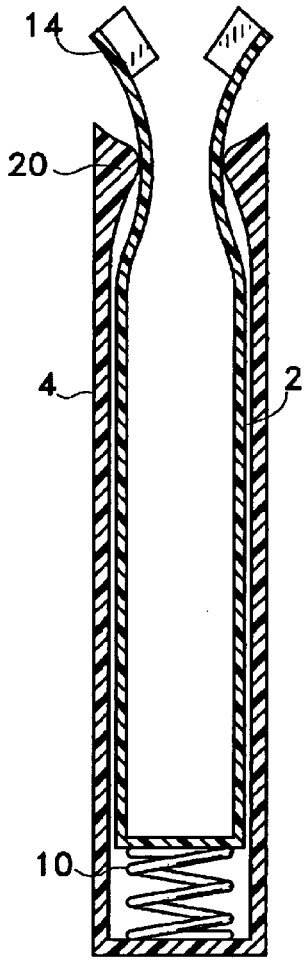
FIG. 1C
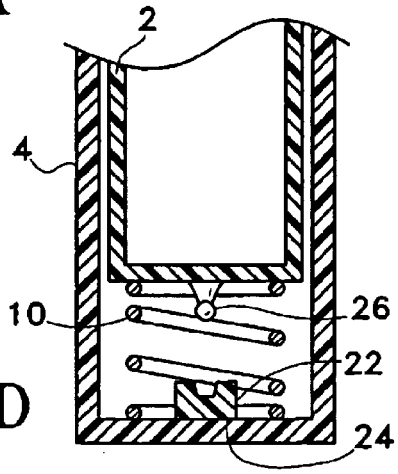
FIG. 1D

GOLF CLUB SAVER

FIELD OF THE INVENTION

The present invention relates to an apparatus for protecting/separating golf clubs in a golf bag and for facilitating convenient insertion and retrieval of golf clubs from a golf bag. In particular, the invention relates to a protective tube for storing a golf club.

BACKGROUND OF THE INVENTION

Golf is a popular sports enjoyed by many around the world. A typical golfer is armed with a collection of golf clubs for striking golf balls. It is common for a golfer to carry three to five woods, and nine or more irons in a golf bag. On common problem for golfers is that after removal of one or more clubs from the golf bag to hit the golf ball, the golfer forgets to place the clubs back into the bag. For example, when the golfer is close to the green, he may remove the pitching wedge and the putter from the golf bag to strike the ball. After delivering the ball onto the green with the pitching wedge, the golfer would lay the pitching wedge on the ground and putt the ball into the hole. However, out of excitement of completing the shot the golfer may forget to retrieve his pitching wedge. Thus, a golf club holding apparatus that can indicate to the golfer that a golf club is absent form the golf bag is desirable.

Another common problem commonly experienced by most golfers is that the heads for the golf clubs tent to strike against each other when the golf bag carrying the clubs is moved. This problem is particular prominent when the bag is carried by the golfer as he walks. The bouncing motion in the gates of the golfer may lead to repeated contact between the heads of the golf clubs. It is desirable to have an apparatus for holding and/or protecting the heads of the golf clubs. An apparatus for holding the heads of the golf clubs or securing the position of the clubs relative to the golf bag may be particularly useful.

Yet another common problem in golfing is that sometimes it is difficult to identify the desired clubs within the group of 13 or more clubs. Since all the irons have similar shape and color, it is hard to quickly locate the desired club. For most golfers, it is common to use clubs of certain sizes and configurations more regularly than others during a golf game. For example, a particular golfer might use the pitching wedge and the seven-iron on a regular basis during a golf game, and never touch the four-iron. In this situation, it may be desirably to raise the height of these two clubs within the golf bag so they can easily be identified. An apparatus that allows the golfer to raise the height of selective golf clubs in the bag and lower them at will, may provide significant convince to the golfers.

Various devices have been devised for holding, separating and/or protecting golf clubs. Examples of such devices are disclosed in U.S. Pat. No. 4,746,014 issued May 24, 1988 to Very; U.S. Pat. No. 5,050,884 issued Sep. 24, 1991 to Flory; U.S. Pat. No. 5,950,823 issued Sep. 14, 1999 to Flis; U.S. Pat. No. 6,343,692 issued Feb. 5, 2002 to Park; U.S. Pat. App. Pub. No. 2002/0108873 published Aug. 15, 2002 by St. Jeor; U.S. Pat. App. Pub. No. 2002/0132679 published Sep. 19, 2002 by Wilde et al.; Japan Pat. No. JP 09-302,577 issued May 25, 1999 to Nishimura et al.; each of which is incorporated here in by reference in its entirety.

An apparatus for storing individual golf clubs and capable of indicating the absence of the golf clubs is much desired. Preferably, the apparatus may have build-in mechanisms for securing the position of the golf club within the storage apparatus. The apparatus may also be capable of raising the position of the golf club to draw attention to the golf club. Furthermore, such apparatus may also include markers, coloring, numbers, or other indicia to indicate the absence of a particular golf club.

SUMMARY OF THE INVENTION

The present invention relates to an apparatus for use with a golf club. The apparatus comprises of three parts: an outer tube, an inner sleeve, and a biasing element (e.g., spring, coil, helical compression element, etc.). The outer tube is a hollow tube. The outer tube may be open on both ends or closed at one end. The inner sleeve is placed within the confines of the outer tube. The inner sleeve and the outer tube may be concentrically aligned. The inner sleeve is adapted to receive a golf club therein. Although it is preferable that the inner sleeve is adapted to receive one golf club, alternative variation of the design may receive two or more clubs. A biasing element is positioned between the outer tube and the inner sleeve. The biasing element is adapted for displacing the inner sleeve within the outer tube. In one variation, the biasing element is placed on the interior bottom surface of the outer tube, and in another variation, the biasing element is place between the inner circumferential surface of the outer tube and the outer circumferential surface of the inner sleeve. The upper end of the inner sleeve may include a set of gripper elements or extend arms adapted to contact a golf club when the inner sleeve is pushed in a downward direction. The gripper element may comprise of a clamp, a vice, a fastener, a brace, a coupler, or other structures for trapping or holding a golf club. Although a tubular body is preferred, one skilled in the art would appreciate that the outer tube and the inner sleeve may have non-circular cross-sections (e.g., rectangular, pentagonal shape, octagonal shape, etc.). In addition, it is preferable, but not necessary, that the inner sleeve be concentrically aligned with the outer tube.

A latch or locking mechanism may be provided for securing the position of the inner sleeve within the outer tube. In one variation, a latch is configured to hold the inner sleeve in place when the inner sleeve is withdrawn into the outer tube and the biasing element is compress between the inner sleeve and the outer tube. A stop may be provided on the inner surface of the outer tube and/or on the outer surface of the sleeve for controlling the position of the inner sleeve when it is displaced upward. The stop may be a series of projections extending radially inwardly to the concentric axis of the outer tube, or a collar, formed by any known welding, molding, polymer injection or fitting process. A stop may be used to define the extended or up position of the inner sleeve. A stop may also be provided to define the retracted or down position of the inner sleeve. Stops may also be used to position the biasing element between the inner sleeve and the outer tube. Portion of the outer surface of the inner sleeve may be in contact with the inner surface of the outer tube to facilitate alignment between the inner sleeve and the outer tube.

In one variation, the inner sleeve is spring loaded and retractable. The biasing element is biased so that the inner sleeve maintains its extended or up position even when a golf club is placed within the sleeve. The upper portion of the inner sleeve may extend beyond the outer tube or stay inside the outer tube when the inner sleeve is in the extended position depending on design preference. As the inner sleeve is pushed down downward into the retracted position, a latch is engaged to hold the inner sleeve in the retracted position.

In one variation the latch is released by pushing the inner sleeve in a downward direction. This action releases the latch and allows the biasing element to push the inner sleeve and the club within the inner sleeve in an upward direction. Alternatively, a release mechanizing may be interconnected with the latch so that when the user push/pull on the release mechanism or actives the release mechanism, the latch would release the inner sleeve and allow it to rise upwards.

In an alternative variation, the upper end of the inner sleeve includes a set of gripper elements adapted to contact a golf club when the inner sleeve is pushed in a downward direction. As the inner sleeve is pushed into the retracted position, a latch is engaged to hold the inner sleeve in a stationary position with the gripper elements pushed toward a central axis of the inner sleeve. To release the latch and the gripper elements, the inner sleeve may be pushed in a downward direction. This action releases the hold of the latch and allows the biasing element to push both the inner sleeve and the golf club within the inner sleeve in the upward direction. As the inner sleeve rises, the gripper elements expand radially to allow for retrieval of the club from the sleeve. In one example, the gripper elements are designed trap the club head when the inner sleeve is retracted. In another example, the gripper elements are designed to trap the shaft of the golf club when the inner sleeve is retracted. In yet another example, the gripper elements traps both the head and the shaft of the golf club when the inner sleeve is retracted. It may also be possible to place the gripper elements within the inner sleeve, such that when the inner sleeve is pushed downward the gripper elements within the inner sleeve will trap the shaft of the golf club.

In another variation, the inner sleeve does not have extended gripper elements. Instead, the gripper elements are adapted at the upper portion of the outer tube. The gripper elements may be interlocked or associated with the inner sleeve, such that when the inner sleeve is pushed in a downward direction the gripper elements are displaced toward a central axis of the inner sleeve. A latch or locking mechanism may be provided to keep the inner sleeve at the retracted position.

In yet another variation, the arrangement of the outer tube, the inner sleeve and the biasing element allows the inner sleeve to rise to the extended or up position once the weight of the golf club is removed. When a golf club is placed within the inner sleeve, the weight of the golf club forces the inner sleeve to move downward toward the bottom of the outer tube. In one example, a compliant biasing element with a reactive spring force (or a resilient restoration force) greater than the weight of the inner sleeve and less than the combined weight of the inner sleeve and the golf club is implement in the apparatus. Thus, when a golf club is placed inside the inner sleeve the combined weight of the golf club and the inner sleeve will force the biasing element to compress and resulting in the retraction of the inner sleeve. When the golf club is removed, the biasing element expands and forces the inner sleeve to rise to the extended or up position. When the inner sleeve is at the extended or up position, the upper portion of the inner sleeve may be exposed or it may stay within the outer tube depending on design preference.

Gripper elements may also be provided either at the upper portion of the inner sleeve or within the inner sleeve, such that as the weight of the club forces the inner sleeve to displaced downward due to the weight of the club, the gripper element will contract or collapse inward to trap the golf club. When the user pulls the golf club upwards, the decrease in weight will allow the inner sleeve to rise and at the same time forces the gripper elements to expand outwards and release the golf club. In one example, the inner sleeve is comprised of a short tubular portion with arms extending upward form the short tubular portion to form the gripper elements. The apparatus may be configured such that the lower tubular portion of the inner sleeve stays within the outer tube all the time, regardless of whether the inner sleeve is in the retracted position or the extended position. In one variation, the distal end of the gripper elements are exposed out side of the outer tube all the time, regardless of whether the inner sleeve is in the retracted position or the extended position. In another variation, the distal end of the gripper elements extended outside the outer tube when the inner sleeve is in the extend position, and retracts within the outer tube when the inner sleeve is in the retracted position. The gripper elements may trap or compress against the club head or the shaft of the club depending on design preference.

Alternatively, the gripper element may be positioned at the upper portion of the outer tube. The gripper elements may be interlocked or associated with the inner sleeve such that when the weight of the golf club forces the inner sleeve to move downward towards the bottom of the outer tube, the gripper elements well contract toward the center axis of the outer tube. As the user pulls the golf club upwards, the decrease in weight allows the inner sleeve to rise and forces the gripper elements to expand outwards away from the center axis of the outer tube.

A plurality of golf club storage apparatus may be placed in a container or a golf bag to serve as an integrated storage unit for carrying multiple golf clubs. A divider plate or a frame may be provided to secure the position of the individual golf club storage apparatus relative to each other. Alternatively, the golf club storage apparatuses may be attached directly to the interior of the golf bag, or be attached to a build-in frame within he golf bag. Marking, coloring, glow in the dark materials/paint or other indicia may be placed on the storage apparatuses to differentiate the individual golf club storage apparatus within a bag for storage of different clubs. For example, numbering or coloring maybe provided on the gripper, on the outer surface of the outer tube, or on the upper portion of the inner tube, to identify the storage apparatus for storing a particular golf club. In another variation, fluorescent coloring, glow in the dark materials, a color ring or band may be placed on the gripper, the upper portion of the inner sleeve, or the inner tube, to assist the user in identifying whether the device is in a retracted state or extended state. Fluorescent coloring, markers or color bands may also be used to enhance the gripper elements so that the user may easily distinguish the expended gripper elements form the closed gripper elements that surrounds it.

These and other embodiments, features and advantages of the present invention will become more apparent to those skilled in the art when taken with reference to the following description of the invention in conjunction with the accompanying drawings.

BRIEF DESCRIPTION OF THE DRAWING

In the accompanying drawings, reference characters refer to the same parts throughout the different views. The drawings are intended for illustrating some of the principles of the golf club saver and are not intended to limit the invention in any way. The drawings are not necessarily to scale, emphasis instead being placed upon illustrating the depicted principles in a clear manner.

FIG. 1A is a partially transparent view illustrating one variation of a golf club storage apparatus having a inner sleeve with extended arms forming the gripper elements. The inner sleeve is shown in the extended or up position.

FIG. 1B illustrates the golf club storage apparatus shown in FIG. 1A with a golf club placed inside the inner sleeve. The apparatus is shown with the inner sleeve in the retracted or down position.

FIG. 1C is a cross-sectional view of one variation of a golf club storage apparatus having guides on the inner surface of the outer tube to assist the bending of the gripper elements when the inner sleeve is retracted.

FIG. 1D is a cross-sectional view of the bottom portion of one variation of a golf club storage apparatus. The figure illustrates a latch and a corresponding locking mechanism for securing the inner sleeve when the inner sleeve is in the retracted position.

DESCRIPTION OF THE INVENTION

Figure 2A:
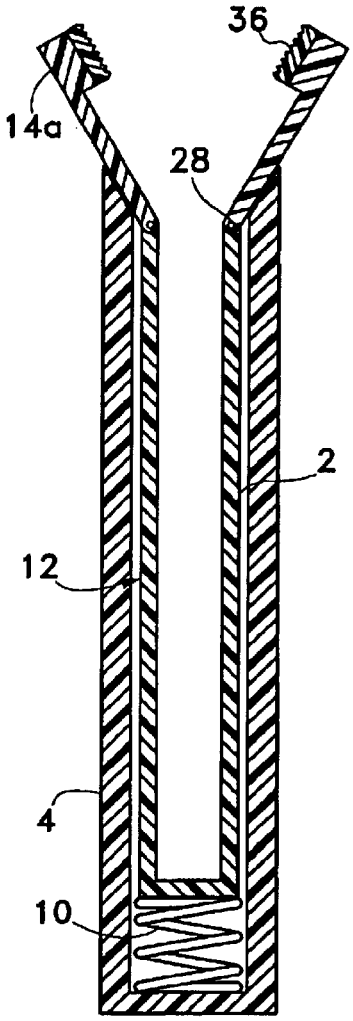
FIG. 2A is a cross-sectional view of another variation of a golf club storage apparatus. In this variation, the gripper elements, which are comprised of separate parts, are connected to the distal end of the inner tube to form the inner sleeve.

Before describing the present invention, it is to be understood that the storage of golf clubs is used herein as an example application to illustrate the functionality of the different aspects of the invention disclosed herein. It will be understood that embodiments of the present invention may be applied in a variety of applications for organizing or storing elongated tools or devices.

It will also be understood that variations of the present invention may be applied in combination with various apparatus for carrying golf clubs, and it is not limited to the specific examples describe herein.

It must also be noted that, as used in this specification and the appended claims, the singular forms "a," "an" and "the" include plural referents unless the context clearly dictates otherwise. Thus, for example, the term "a spring" is intended to mean a single spring or a plurality of springs, "a gripper" is intended to mean one or more grippers, or a combination there of.

One variation provides an inner sleeve 2 slidably disposed within an outer tube 4, as seen in FIG. 1A. The outer tube 4 is open at the top end 6 and close at the bottom end 8. The outer tube may 4 comprise of metal, metal alloys, plastic, or polymers such as polystyrene, acrylic polymers, PVC, ABS, polycarbonate or other suitable polymeric materials that are well known to one skilled in the art. A spring 10 is positioned at the bottom of the outer tube 4 for displacing the inner sleeve 2. The inner sleeve 2 comprises an inner tube 12 and anus extending form the top portion of the inner tube forming the gripper elements 14. The gripper elements 14 may comprise of separate parts that can be connected to the inner tube. Alternatively, the gripper elements 14 and the inner tube 12 may be formed of a signal piece of polymeric or metallic material. For example, the inner sleeve 2 may be molded into the desirable shape through plastic injection molding. A practitioner of ordinary skilled in the art would be able to select the appropriate polymeric material and shaped the arm extensions to form the gripper element such that when the sleeve is pushed down into the outer tube, the boundary formed by the wall of the outer tube will force the gripper element to bend inward toward the central axis of the outer tube. When the spring 10 expends and pushes the inner sleeve 2 upward, the distal end 16 of the gripper elements 14 will expend outward away from the central axis. Metal or metal alloyed may be embedded within the arm extensions forming the gripper elements 14 to enhance their strength.

Padding (e.g., soft pile material, or polymeric material) may be place on the inner surface of the gripper elements 14 to enhance the gripping action or to protect the golf club from abrasions. The padding materials may be placed on the distal 16 or top end of the gripper elements 14 or along the length of the ripper elements 14. Wedges, braces, brackets and other holders may be placed along the gripper elements to enhance the grippers' ability to secure the golf club.

In one variation, the spring 10 supporting the inner sleeve has a reactive spring force greater than the combined weight of the inner sleeve 2 and the golf club. Preferably, the reactive spring force is just slightly greater than the combined weight of an average golf club and the inner sleeve 2, such that when the golf club is placed inside the inner sleeve 2 the user can push the inner sleeve 2 downward without exerting excessive amounts of force. It is preferable that the reactive spring force is less than the combined weight of an average club plus the weight of the inner sleeve 2 plus one kilogram of weight; it is more preferable that the reactive force is less than the combined weight of an average club plus the weight of the inner sleeve 2 plus five hundred grams of weight; it is even preferable that the reactive spring force is less than the combined weight of an average club plus the weight of the inner sleeve 2 plus 300 grams of weight.

In this variation, when a club is place inside the inner sleeve 2, the inner sleeve will stay in its extended or up position. When the user exerts a force to push the golf club downward, the sleeve 2 is also forced downward into the outer tube 4 and the gripper element 14 will collapse inward towards the golf club 18, as seen in FIG. 1B. A guide 20, a contour or other structural features may be adapted inside the inner circumferential a surface of the outer tube 4 to assist the distal end of the gripper elements 14 to move inward toward the central axis of the outer tube as the inner sleeve 2 is pushed down into the outer tube 4, as shown in FIG. 1C. In one variation, the distal ends of the gripper elements 14 form a container that surround the club head when the inner sleeve is retracted. In another variation, the gripper elements 14 may form a conical shape at the distal portion of the gripper elements 14 when the inner sleeve 4 is in the extended position. When the inner sleeve 4 is pushed downward, the cone at the distal portion of the gripper element may collapse and traps the head or the shaft of the golf club 18. In yet another variation, coloring or markers are provided on the gripper elements so they may be easily identified. For example, the gripper elements may be embedded, painted or coated with fluorescent or glow in the dark materials.

A latch or locking mechanism 22 may be provided to hold the inner sleeve in the retracted position. An example of a locking mechanism 22 is shown in FIG. 1D. In this example, a push-and-release locking mechanism is provided on the inner bottom surface 24 of the outer tube 4. The spring 10 surrounds the locking mechanism 22. A corresponding latch 26 is positioned at the outer bottom surface of the inner sleeve 2. When the inner sleeve 2 is pushed all the way down into the outer tube 4, the latch 26 extends into the locking mechanism 22 and engages the lock. As the result, the expansion force of the spring 10 is countered-acted by the engaged locking mechanism, and the inner sleeve 2 stays in the retracted position. When the user wants to retrieve the golf club, the user simply pushes down on the golf club or the inner sleeve 2, and the downward force is transferred to the locking mechanism. This transfer of force will release the latch 26, thus allowing the inner sleeve to rise to the extended position. Other retractable mechanisms or locking mechanisms well known to one skilled in the art may also be implemented for securing the inner sleeve at the retracted position. For example, latching mechanisms commonly used in the retractable ballpoint pens may also be adapted in the present design to provide lock-and-release of the inner sleeve.

Although in this particular design the spring 10 is shown at the bottom of the outer tube 4, the spring may also be placed between the inner sleeve and the outer tube. Other biasing mechanisms that are well known to one skilled in the art may also be used to displace the inner sleeve 2 inside the outer tube 4.

Alternatively, a spring 10 with less reactive spring force may also be used. In this variation, the spring 10 supporting the inner sleeve 2 has a reactive spring force greater than the weight of the inner sleeve 2 and less than the combined weight of the inner sleeve 2 and the golf club. When a golf club is place inside the inner sleeve 2, the weight of the club is enough to force the inner sleeve 2 to retract downward, and as the consequence, the gripper element 14 will close and trap the golf club. In this variation, a locking and/or latching mechanism is optional. When the user wish to remove the golf club, the user simply pull the golf club upward and the inner sleeve 2 will rise and cause the grippers 14 to release the golf club.

Figure 2B:
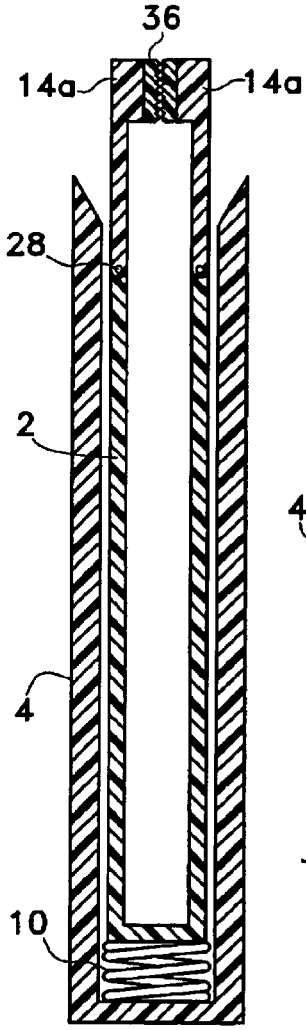
FIG. 2B illustrates the golf club apparatus shown in FIG. 2A with its inner sleeve in the retracted or down position.

In an alternative design, the grippers 14 are comprised of separate parts that are connected to a inner tube 12 to form the inner sleeve 2. FIG. 2A illustrates one example of such a design. The inner sleeve 2 is shown in its extended or up position. The connection joints 28 where the gripper elements 16 are connected to the inner tube 12 may be spring-loaded such that the gripper elements 14*a* tend to expand outward away from the central axis of the outer tube 4. When the inner sleeve 2 is pushed downward, as shown in FIG. 2B, the wall of the outer tube forces the gripper elements 14*a* to close and move towards the central axis of the outer tube 4 to trap a golf club. The gripper element 14*a* may be configured to trap the club head and/or the shaft of the golf club.

Figure 2C:
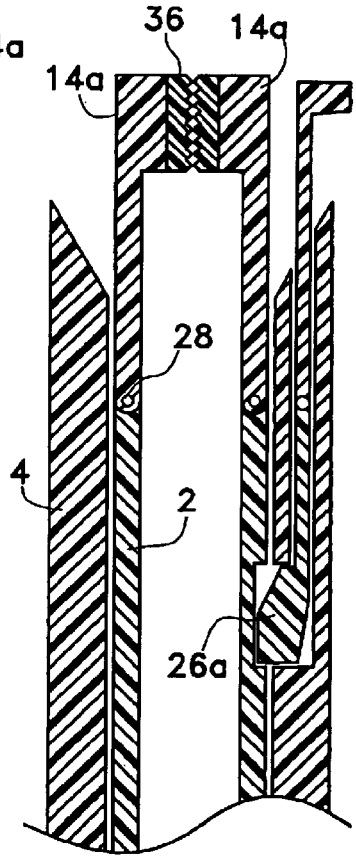
FIG. 2C illustrates another variation of the golf club apparatus shown in FIG. 2A with an integrated locking mechanism for keeping the inner sleeve in the retracted position.
Figure 2D:
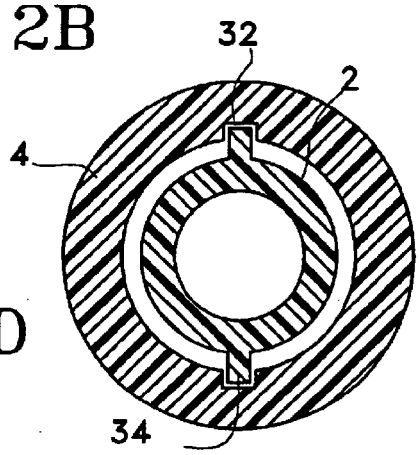
FIG. 2D is a cross-sectional view of a golf club apparatus illustrating another design variation where groves and corresponding guides are implemented to prevent rotation of the inner sleeve relative to the outer tube.

In one variation the spring 10 has a weak bias such that when a golf club is placed inside the inner sleeve the weight of the club will force the inner sleeve to slide downward and consequently forcing the gripper elements 14*a* to close. In another variation, the spring 10 has a strong bias such that when a golf club is placed inside the inner sleeve the inner sleeve 2 will maintain its extended or up position. The user may force the inner sleeve 2 to retract by pushing down on the golf club. A latch or locking mechanism may be provided to secure the inner sleeve in the retracted position. When the user desires to use the golf club, he may release the locking mechanism and the inner sleeve will popup and releases the grippers. A push-and-release locking mechanism described above may also be implemented in this variation. Alternatively, a latch 26*a* may be built into the outer tube 4 for keeping the inner sleeve 2 in the retracted position as seen in FIG. 2C. Grooves 32 on the inner surface of the outer tube 4 and corresponding guides 34 on the outer surface of the inner sleeve 2 may be provided to prevent the inner sleeve 2 from rotating relative to the outer tube 4, as illustrated in FIG. 2D. Alternatively, the grooves may be placed the inner sleeve and the guides positioned on the outer tube.

In variations where the gripper elements 14 and the inner tube 12 are formed of separate parts, the inner tube 12 may comprise of metal, metal alloys, plastic, or polymers such as polystyrene, acrylic polymers, PVC, ABS, polycarbonate or other suitable polymeric materials that are well known to one skilled in the art. The gripper element 14 may comprise of metal, metal alloys, plastic, or polymers such as polystyrene, acrylic polymers, PVC, ABS, polycarbonate or other suitable polymeric materials that are well known to one skilled in the art. Metal or metal alloyed may be embedded within the gripper elements 14 to enhance their strength. Padding 36 (e.g., soft pile material, polymeric materials, non-slip materials) may be place on the inner surface of the gripper elements to enhance the gripping action or to protect the golf club from abrasions. The padding 36 may be attached to the gripper with various adhesive or bonding materials (e.g., acrylic, cyanoacrylate/methacrylate, epoxy, heat activated adhesives, hot melt adhesives, hydrocolloid/hydrogel, moisture-cure adhesives, polyester, silicone, urethane, UV or light-cure adhesives, etc.) that are well known to one skilled in the art. Alternatively, a groove, duct or slot may be provided on the gripper for securing the padding.

The length of the gripper' element 14 may be varied by design, as one skilled in the art would appreciate. In one variation, when the sleeve 2 is in the retracted state, the distal end 16 of the gripper 14 extends beyond the top of the outer tube 4. In another variation, when the sleeve 2 is in the retracted state, the gripper 14 is drawn into the outer tube 4 and does not protrude from the outer tube 4.

Figure 3:
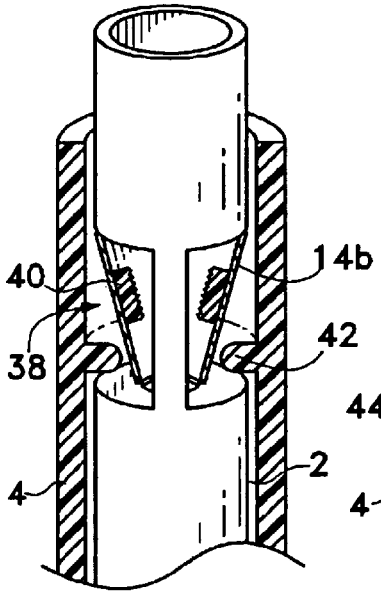
FIG. 3 is a cross-sectional view of another variation of a golf club apparatus, where a gripper element is integrated in the midsection of the inner sleeve.

In another variation, the gripper 14 is positioned on the midsection 38 of the inner sleeve 2 and hidden from view inside the outer tube. In one example, as seen in FIG. 3, the gripper element 14*b* comprises a conical shaped surface that is flexible, and a soft pile material 40 is attached to the inner surface of the cone for trapping the shaft of a golf club. The inner sleeve 2 is shown in an extended or up position in FIG. 3. When the inner sleeve 2 is pushed downward into the outer tube 4, the guide 42 or contour on the inner surface of the outer tube will force the conical shaped gripper to collapse inward and trapping the shaft of the golf club. In another variation, the gripper comprises a clamp for trapping the shaft.

Figure 4:
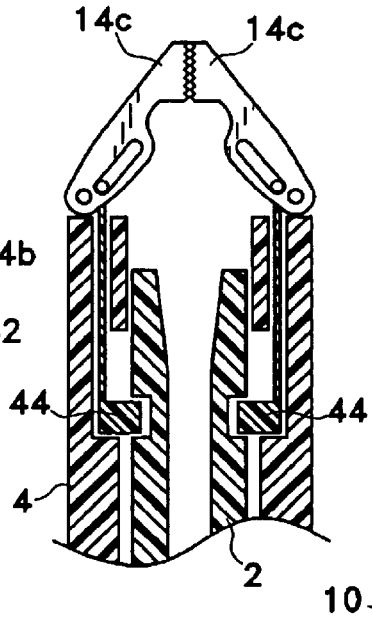
FIG. 4 is a cross-sectional view of yet anther variation of a golf club storage apparatus where the gripper elements are implemented on the upper portion of the outer tube.

In another design variation, the gripper elements 14 extend from the upper portion of the "outer" tube 4. In one example, shown in FIG. 4, elongated structures are connected at the top end of the outer tube to form the gripper elements 14*c*. Interlocking connectors 44 are built into the outer tube 4 so that movement of the inner sleeve 2 will result in opening or closing of the gripper elements 14*c*. When the inner sleeve 2 is raised, the inner sleeve 2 pushes on the interlocking elements 44, which forces the gripper element 14*c* to open and release the golf club. When the inner sleeve 2 is lowered, the inner sleeve 2 pulls on the interlocking elements 44, which forces the gripper element 14*c* to close and traps the golf clubs inside the inner sleeve 2. The gripper elements 14*c* may be configured to trap the club head, the shaft or both parts of the golf club. The gripper elements 14*c* may be configured such that there is room for the user to access and grab the golf club even when the gripper elements 14*c* are closed. The apparatus may be configured with a biasing element 10 so that the inner sleeve would retract when a golf club is place inside the inner sleeve 2. Alternatively, the apparatus may be configured with a stronger biasing element 10 so that the inner sleeve 2 would maintain in its extended or up position when a golf club is placed inside the inner sleeve 2. The user would have to push down on the golf club to force the inner sleeve 2 to refract and move downward. A locking mechanism 22 and/or latches may be provided to secure the inner sleeve 2 at the retracted or down position at the user's discretion. The apparatus may be configured so that when the inner sleeve 2 is in the extended or up position the top portion of the inner sleeve 2 will extend beyond the top end of the outer tube. Alternatively, the apparatus may be configured so that when the inner sleeve 2 is in the extended or up position the top portion of the inner sleeve 2 will not extend beyond the top end of the outer tube 4.

In another design variation, the gripper element is configured as a housing that covers the head of the golf club. When the inner sleeve is raised, the housing may rise or open to provide access to the golf club. The housing may be interlocked with the outer tube, the inner sleeve or both.

Figure 5A:
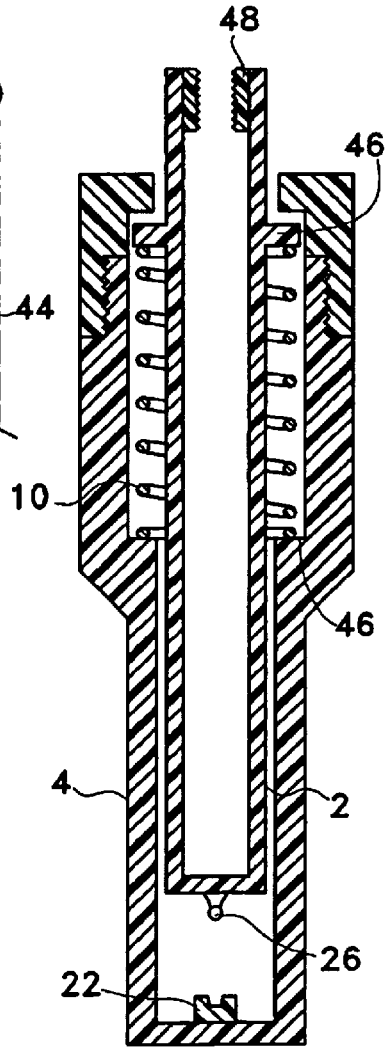
FIG. 5A is a cross-sectional view of another variation of a golf club apparatus where the bias element is implemented between the inner circumferential surface of the outer tube and the outer circumferential surface of the inner sleeve.
Figure 5B:
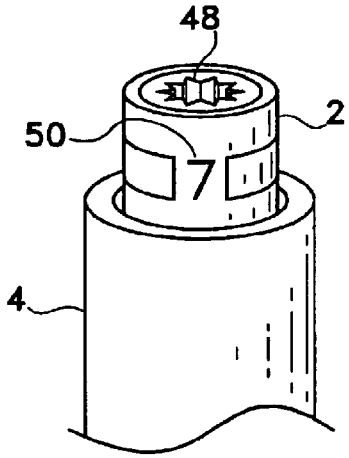
FIG. 5B is a plan view of the golf club apparatus shown in FIG. 5A, illustrating the placement of indicia on the upper portion of the inner sleeve.

In yet another design variation, the golf club storage apparatus is configured without the gripper elements. In one example, illustrated in FIG. 5A, the inner sleeve 2 is shown in its extended position. A spring 10 with a reactive spring force greater than the combined weight of the golf club and the inner sleeve is implemented between the inner circumferential wall of the outer tube 4 and the outer circumferential wall of the inner sleeve 2. Stoppers 46 are positioned on the inner sleeve and outer tube to allow the inner sleeve 2 and the outer tube 4 to inter act with the spring 10. A locking mechanism 22 located at the bottom of the outer tube can interlock with a corresponding latch 26 that is connected to the bottom of the inner tube. An acrylic pile 48 may be place on the inside of the inner sleeve 2 near the top opening to protect the shaft of the golf club. An optional indicia 50 may be placed on the outer circumferential surface of the inner sleeve 2 to provide information that may be useful to the user, as illustrated in FIG. 5B. Indicia 50 such as lettering, numbering, markers, logos, borders, coloring, fluorescent coloring/materials, glow in the dark coloring/materials, and the like may be impressed, formed, painted or taped on the outer surface of the inner sleeve 2. Indicia 50 may also be molded onto the surface of the inner sleeve during the manufacturing process.

Although in this example, the spring 10 is shown at the upper portion of the apparatus, the spring 10 may also be placed anywhere along the length of the inner sleeve 2, or at the bottom of the outer sleeve 4. Various locking mechanisms 22 that are well known to one skilled in the art may also be implemented for locking the inner sleeve at the retracted position. The locking mechanism 22 may be implemented at the bottom of the outer tube as shown in FIG. 5A. Alternatively, the locking mechanism may also be implemented along the length of the outer tube 4.

Figure 6A:
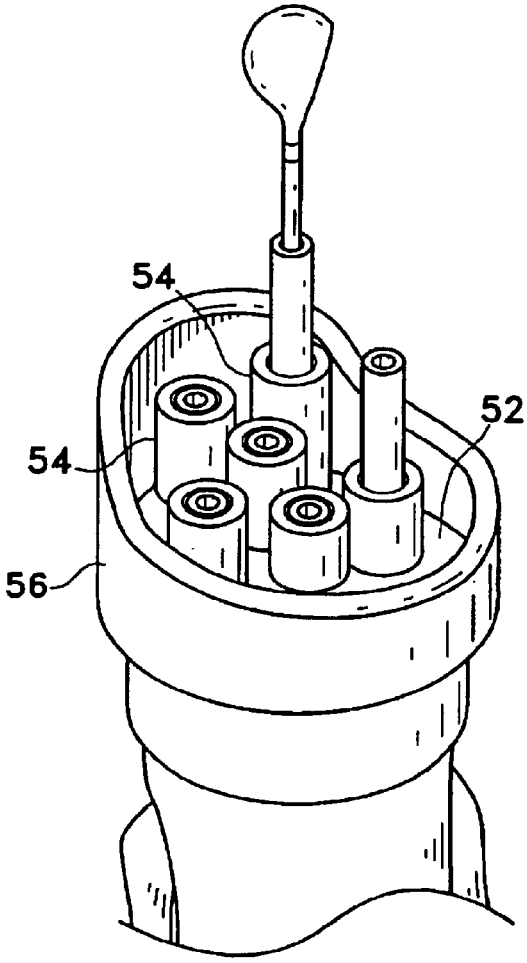
FIG. 6A is a perspective view showing one approach for placing multiple golf cub storage apparatuses inside a golf bag. In this variation, a divider plate is used to secure the golf club storage apparatuses within the golf bag.
Figure 6B:
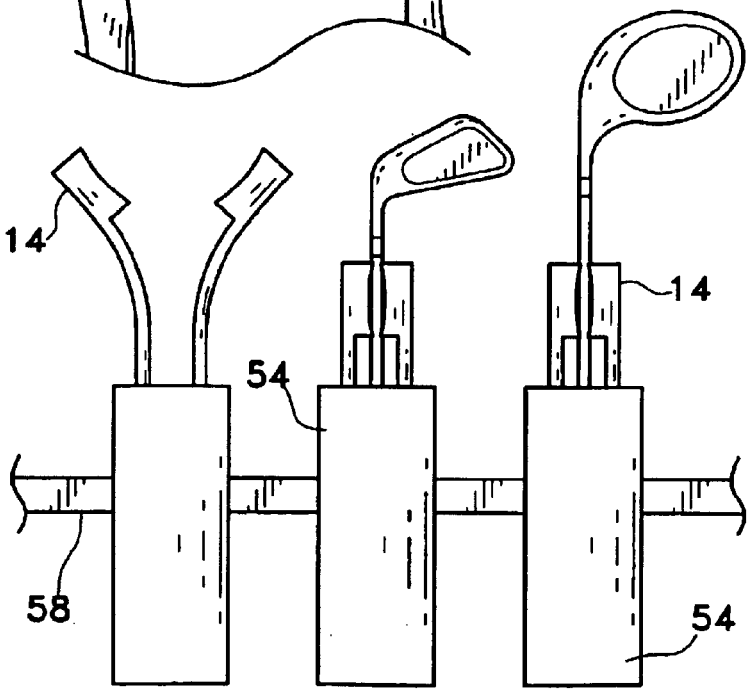
FIG. 6B illustrates another variation of a multiple golf club storage system, where the individual golf club storage apparatuses are anchored on a bracket. In this variation, the inner sleeves have gripper elements for securing the golf clubs.

A plurality of golf club storage apparatus may be incorporated with a storage container or a golf bag for storage and transport of multiple golf clubs. A divider plate 52 or frame may be implemented to secure the individual apparatus. FIG. 6A illustrates one variation where multiple golf club storage apparatus 54 are positioned inside a golf bag 56, and a divider plate 52 is implemented to secure their positions within the golf bag. In another variation, a bracket 58, as seen in FIG. 6B, anchors multiple golf club storage apparatuses 54 that have integrated gripper elements 14.

All publications and patent applications cited in this specification are herein incorporated by reference in their entirety as if each individual publication or patent application were specifically and individually put forth in the text.

This invention has been described and specific examples of the invention have been portrayed. While the invention has been described in terms of particular variations and illustrative figures, those of ordinary skill in the art will recognize that the invention is not limited to the variations or figures described. Additionally, to the extent there are variations of the invention, which are within the spirit of the disclosure or equivalent to the inventions found in the claims, it is my intent that this patent will cover those variations as well.

I claim the following:

1. A golf club storage apparatus comprising:

an elongated tube having a top end and a bottom end;

a sleeve adapted for holding a golf club, wherein said sleeve is slidably positioned within said elongated tube;

a biasing element position between said elongated tube and said sleeve wherein said biasing element is adapted to bias the position of said sleeve relative to said elongated tube;

a latch adapted to secure said sleeve inside said elongated tube when said biasing element is compressed; and wherein said biasing element has a resilient restoration force that is greater than a combined weight of said sleeve and a golf club.

2. The golf club storage apparatus of claim 1 further comprising:

an indicia located on the sleeve.

3. A golf club storage apparatus comprising:

an elongated tube having a top end and a bottom end;

a sleeve adapted for holding a golf club, wherein said sleeve is slidably positioned within said elongated tube;

a biasing element position between said elongated tube and said sleeve wherein said biasing element is adapted to bias the position of said sleeve relative to said elongated tube;

a latch adapted to secure said sleeve inside said elongated tube when said biasing element is compressed;

wherein said sleeve comprises an inner tube and a gripper connected to said inner tube; and wherein said inner tube does not extend beyond the top end of said elongated tube when said biasing element is in a an expanded position.

4. A golf club storage apparatus comprising:

an elongated tube having a top end and a bottom end;

a sleeve adapted for holding a golf club, wherein said sleeve is slidably positioned within said elongated tube;

a biasing element position between said elongated tube and said sleeve wherein said biasing element is adapted to bias the position of said sleeve relative to said elongated tube;

a latch adapted to secure said sleeve inside said elongated tube when said biasing element is compressed; and a gripper connected to a top portion of said elongated tube.

5. The golf club storage apparatus of claim 4 wherein said gripper element is interconnected to said sleeve such than when said sleeve is pushed downward into said elongated tube, said gripper element will move inward toward a central axis of said elongated tube.

6. The golf club storage apparatus of claim 4 further comprising:

an indicia located on the sleeve.

7. The golf club storage apparatus of claim 4 further comprising:

an indicia located on the gripper.

8. A golf club storage apparatus comprising:

an elongated tube having a top end and a bottom end;

a sleeve adapted for holding a golf club, wherein said sleeve is slidably positioned within said elongated tube;

a biasing element position between said elongated tube and said sleeve wherein said biasing element is adapted to bias the position of said sleeve relative to said elongated tube;

a latch adapted to secure said sleeve inside said elongated tube when said biasing element is compressed; and wherein said latch is a push-and-engage latch, and said latch is adapted such that when said sleeve is pushed downward into to said elongated tube said latch engages and secures said sleeve, and when said sleeve is subsequently push downward said latch disengages and releases said sleeve.

9. A golf club storage apparatus comprising:

an elongated tube having a top end and a bottom end;

a sleeve adapted for holding a golf club, wherein said sleeve is slidably positioned within said elongated tube;

a biasing element position between said elongated tube and said sleeve wherein said biasing element is adapted to bias the position of said sleeve relative to said elongated tube;

a latch adapted to secure said sleeve inside said elongated tube when said biasing element is compressed;

wherein said sleeve comprises an inner tube and a gripper connected to said inner tube; and a padding attached to said gripper.

10. The golf club storage apparatus of claim 9 wherein said padding comprises a polymeric material.

11. A golf club storage apparatus comprising:

an elongated tube having a top end and a bottom end;

a sleeve adapted for holding a golf club, wherein said sleeve is slidably positioned within said elongated tube;

a biasing element position between said elongated tube and said sleeve wherein said biasing element is adapted to bias the position of said sleeve relative to said elongated tube;

a latch adapted to secure said sleeve inside said elongated tube when said biasing element is compressed;

wherein said sleeve comprises an inner tube and a gripper connected to said inner tube; and a polymeric structure adapted to capture a club head of said golf club, wherein said polymeric structure is attached to a distal end of said gripper.

12. A golf club storage apparatus comprising:

an elongated tube having a top end and a bottom end;

a sleeve adapted for holding a golf club, wherein said sleeve is slidably positioned within said elongated tube;

a biasing element position between said elongated tube and said sleeve wherein said biasing element is adapted to bias the position of said sleeve relative to said elongated tube;

a latch adapted to secure said sleeve inside said elongated tube when said biasing element is compressed; and a gripper attached to said elongated tube, wherein said gripper is configured such that when said biasing element is compressed, the gripper element moves toward said golf club, and when said biasing element is expanded the gripper element moves away from said golf club.

13. The golf club storage apparatus of claim 12 further comprising:

a padding attached to said gripper.

14. The golf club storage apparatus of claim 13 further comprising:

a polymeric structure adapted to capture a club head of said golf club, wherein said polymeric structure is attached to a distal end of said gripper.

15. A protective device for storing a golf club comprising:

a first elongated tube adapted for storing a golf club;

a second elongated tube having an inner diameter greater than the outer diameter of said first tube, wherein said first elongated tube is slidably positioned within said second elongated tube;

a gripper adapted to hold said golf club, wherein said gripper is connected to said first elongated tube;

a spring positioned between said first and second tube, where in said spring is adapted to bias the position of said first elongated tube within said second elongated tube;

a locking mechanism adapted to secure said first elongated tube within said second elongated tube when said spring is compressed; and wherein said spring having a reactive spring force greater than a combined weight of said first elongated tube and an average golf club.

16. A protective device for storing a golf club comprising:

a first elongated tube adapted for storing a golf club;

a second elongated tube having an inner diameter greater than the outer diameter of said first elongated tube, wherein said first elongated tube is slidably positioned within said second elongated tube;

a gripper adapted to hold said golf club, wherein said gripper is connected to said second elongated tube; and a spring positioned between said first and second tube, where in said spring is adapted to bias the position of said first elongated tube within said second elongated tube.

17. The protective device of claim 16 wherein said spring is positioned between an outer bottom surface of said first elongated tube and an inner bottom surface of said second elongated tube.

18. The protective device of claim 16 further comprising:

a locking mechanism for securing said first elongated tube within said second elongated tube when said resilient spring is compressed.

19. The protective device of claim 18 wherein said resilient spring having a reactive spring force greater than a combined weight of said first elongated and an average golf club.

20. The protective device of claim 16 wherein said resilient spring having a reactive spring force greater than a weight of said first elongated tube and less than a combined weight of an average golf club and said first elongated tube.

21. The protective device of claim 16 further comprising:

an interlocking mechanism adapted to connect said first elongated tube to said gripper.

22. A protective device for storing a golf club comprising:

a first elongated tube adapted for storing a golf club;

a second elongated tube having an inner diameter greater than the outer diameter of said first tube, wherein said first elongated tube is slidably positioned within said second elongated tube;

a spring positioned between said first and second tube, where in said spring is adapted to bias the position of said first elongated tube within said second elongated tube;

a gripper adapted to bold said golf club when said spring is compressed, wherein said gripper is integrated within a midsection of said first elongated tube; and wherein said gripper is a clamp.

23. A protective device for storing a golf club comprising:

a first elongated tube adapted for staring a golf club;

a second elongated tube having an inner diameter greater than the outer diameter of said first tube, wherein said first elongated tube is slidably positioned within said second elongated tube;

a spring positioned between said first and second tube, where in said spring is adapted to bias the position of said first elongated tube within said second elongated tube;

a gripper adapted to hold said golf club when said spring is compressed, wherein said gripper is integrated within a midsection of said first elongated tube; and a locking mechanism adapted to secure said first elongated tube within said second elongated tube when said resilient spring is compressed.

24. The protective device of claim 23 wherein said spring having a reactive spring force greater than a combined weight of said first elongated tube and an average golf club.

25. A golf club storage system comprising:

a golf bag;

a plurality of elongated tubes positioned within said golf bag, wherein each of said plurality of elongated tubes further comprising (a) an inner tube slidably positioned within each of said elongated tube, (b) a gripper connected to each of said inner tube, and (c) a spring positioned between each of said elongated tubes and its corresponding inner tube; and wherein each of said plurality of springs having a reactive spring force greater than a combined weight of said inner tube and a golf club.

26. The golf club storage apparatus of claim 25 further comprising:

an indicia located on at least one of the inner tubes.

27. The golf club storage apparatus of claim 25 further comprising:

an indicia located on at least one of the grippers.

* * * * *